US005887358A

United States Patent [19]

Bischel et al.

[11] Patent Number: 5,887,358

[45] Date of Patent: Mar. 30, 1999

[54] POCKET VENTILATION AND SHEET SUPPORT SYSTEM IN A PAPERMAKING MACHINE DRYER SECTION

[75] Inventors: Kevin H. Bischel, South Beloit, Ill.; Thomas K. Grunder, Beloit, Wis.

[73] Assignee: Beloit Technologies, Inc., Wilmington, Del.

[21] Appl. No.: 789,971

[22] Filed: Jan. 31, 1997

[51] Int. Cl.[6] ..... D21F 5/00

[52] U.S. Cl. ..... 34/115; 34/120

[58] Field of Search ..... 34/453, 454, 455, 34/456, 457, 458, 115, 117, 120

[56] References Cited

U.S. PATENT DOCUMENTS

| | | | |
|---|---|---|---|
| 4,539,762 | 9/1985 | Eskelinen et al. | 34/114 |
| 4,669,198 | 6/1987 | Wedel | 34/23 |
| 4,953,297 | 9/1990 | Eskelinen et al. | 34/23 |
| 5,068,980 | 12/1991 | Muller | 34/117 |
| 5,152,078 | 10/1992 | Wedel | 34/115 |
| 5,230,168 | 7/1993 | Heinzmann et al. | 34/117 |
| 5,495,679 | 3/1996 | Deshpande et al. | 34/117 |
| 5,524,360 | 6/1996 | Virta et al. | 34/457 |
| 5,737,848 | 4/1998 | Chau-Huu et al. | 34/115 X |

*Primary Examiner*—Henry A. Bennett
*Assistant Examiner*—Steve Gravini
*Attorney, Agent, or Firm*—Lathrop & Clark

[57] ABSTRACT

A dryer section in a papermaking machine has two reversing rolls to form a pocket between each pair of dryers in a dryer tier. The first reversing roll is a vacuum roll and the second reversing roll is a grooved roll. A blow box is disposed between the two rolls, the blow box provides suction for the grooved roll and provides vacuum which restrains a web on the dryer fabric as it travels between the first and the second rolls. The blow box also provides a supply of make-up air which extends in a cross machine direction along the pocket formed by the two reversing rolls. The blow box also supports a pivoting foil which is positioned against the dryer fabric as it moves from a first dryer, towards the first reversing roll. The foil defines a region of low pressure which restrains the web as it travels between the first dryer and the first reversing roll.

14 Claims, 3 Drawing Sheets

POCKET VENTILATION AND SHEET SUPPORT SYSTEM IN A PAPERMAKING MACHINE DRYER SECTION

FIELD OF THE INVENTION

The present invention relates to papermaking machines in general, and to the dryer section of a papermaking machine in particular.

BACKGROUND OF THE INVENTION

In the papermaking process, a paper web is dried by first having excess water pressed from the web as it is transferred on a support felt through nips formed between press rolls in a press section. The paper web is then threaded from the press section to a dryer section where the web is dried as it passes over a series of heated dryer rolls. The web is backed by a porous felt or dryer fabric as it passes over the dryer rolls. In one conventional approach, a single vacuum guide roll is placed between successive dryer rolls in a tier. The felt-supported paper web travels in a serpentine fashion over the first dryer roll, then over the guide roll, then over a second dryer roll to a second guide roll, and so on through the dryer section. The dryer fabric is positioned between the vacuum roll and the web as it moves from one dryer roll to the next, and the reduced pressure drawn on the dryer fabric by the vacuum roll holds the web to the dryer fabric. Due to high web speeds, which in certain applications reach rates of up to 6,000 feet per minute or more, the web may flutter on the felt as it travels between a dryer roll and a vacuum guide roll. This flutter, which can be attributed to disruptive localized pressure generated along the traveling web, detrimentally affects the quality of the paper web produced and can result in web breaks. Breakage of the web being formed results in undesirable machine shut down and lost efficiency while the papermaking machine is being threaded and restarted.

In response to increased web speeds, attempts have been made to both prevent the web from fluttering on the support felt, and to efficiently maximize the drying of the web at the dryer section. Creating a vacuum in a "pocket" formed between two adjacent dryer rolls and the guide roll between them has been helpful in holding the paper web against the felt as it travels between dryer rolls and guide rolls. For example, a vacuum is formed within the pocket by creating a sealing ledge positioned above the guide roll and between two dryer rolls, so that air flow induced on the first dryer roll by the rapidly moving web is deflected to pass up and away from the pocket. Since the felt is permeable, the lower pressure inside the pocket pulls the web against the support felt, thereby preventing flutter.

By using two grooved guide rolls between adjacent dryer rolls, as in U.S. Pat. No. 5,495,679, the disclosure of which is incorporated by reference herein, dryer efficiency can be improved. Two rolls within the pocket allow a greater fraction of each dryer roll to be wrapped by the web, and hence allows greater drying to take place on each dryer roll. The two pocket rolls may be provided with circumferential grooves and enclosed within a box. Drawing a vacuum on the box not only holds the dryer fabric and the web to the grooved rolls, but also retains the web on the dryer fabric as it extends between rolls. The air drawn out of the pocket by the vacuum box or vacuum roll must be replaced. Typically the required make-up air is drawn in exclusively at the front and back sides of the papermaking machine. A papermaking machine can be 200 to 400 inches wide, and thus a rapid inflow of make-up air from the sides can generate turbulence which disrupts the web edges and compromises runnability and paper quality.

What is needed is an apparatus for ventilating the pocket in a paper machine drying section while providing support for the moving web as it travels between dryer rolls.

SUMMARY OF THE INVENTION

The apparatus of the present invention consists of a dryer section in a papermaking machine which employs two reversing rolls which form a pocket between each pair of dryers in a tier of dryers. The first reversing roll is a vacuum roll and the second reversing roll is a grooved roll. A blow box is disposed between the two rolls, the blow box provides suction for the grooved roll and for the dryer fabric as it travels between the first and the second rolls. The blow box also provides a supply of make-up air which extends in a cross machine direction along the pocket formed by the two reversing rolls. The make-up air thus supplied prevents an inrush of air from the machine ends. The blow box supports a pivoting foil which is positioned against the dryer fabric as it moves from a first dryer, towards the first reversing roll. The foil separates the boundary layer of air from the dryer fabric as it enters the pocket formed by the reversing rolls. The foil defines a region of low pressure. The low pressure is caused by the foil deflecting the boundary layer and by the vacuum provided by the first reversing roll. Thus the two reversing rolls and the blow box with attached foil provide a means for drawing the paper web against the drying fabric as the web moves between adjacent dryer rolls.

It is a feature of the present invention to provide an apparatus that both efficiently ventilates a pocket and dries a paper web in a papermaking machine dryer section.

It is also a feature of the present invention to provide a method for introducing vacuum pocket make-up air all across the pocket in a papermaking machine dryer section.

It is another feature of the present invention to provide an apparatus that holds a paper web to a support felt as it travels between dryer rolls in a dryer section.

It is yet another feature of the present invention to provide a web transfer mechanism between dryer rolls that can accommodate paper wads that accumulate and travel around a dryer roll.

Further objects, features and advantages of the invention will be apparent from the following detailed description when taken in conjunction with the accompanying drawings.

DESCRIPTION OF THE PREFERRED EMBODIMENT

Figure 1:
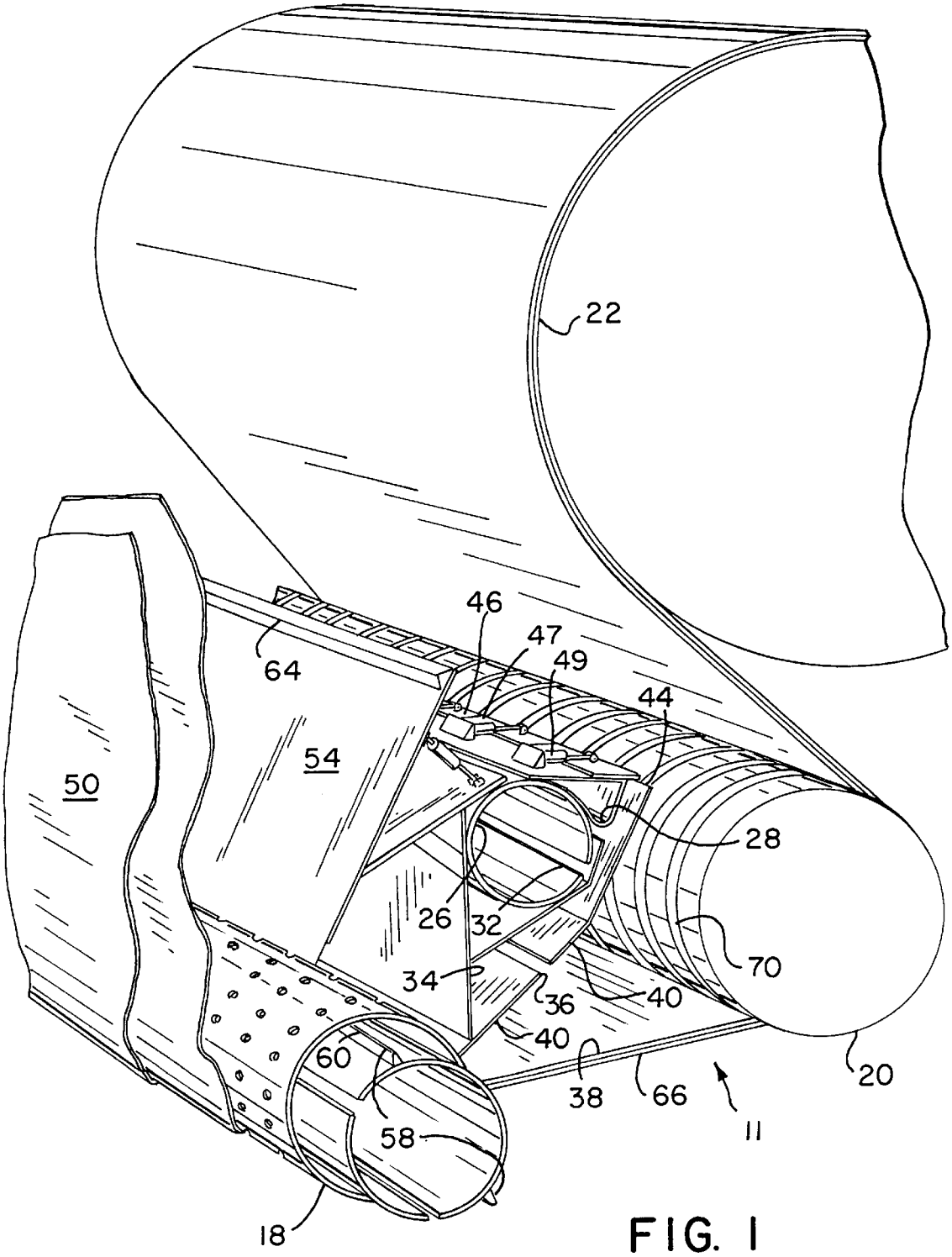
FIG. 1 is an illustrative perspective view, not to scale, and partially broken away in section of a portion of a papermaking machine dryer section of the present invention.
Figure 2:
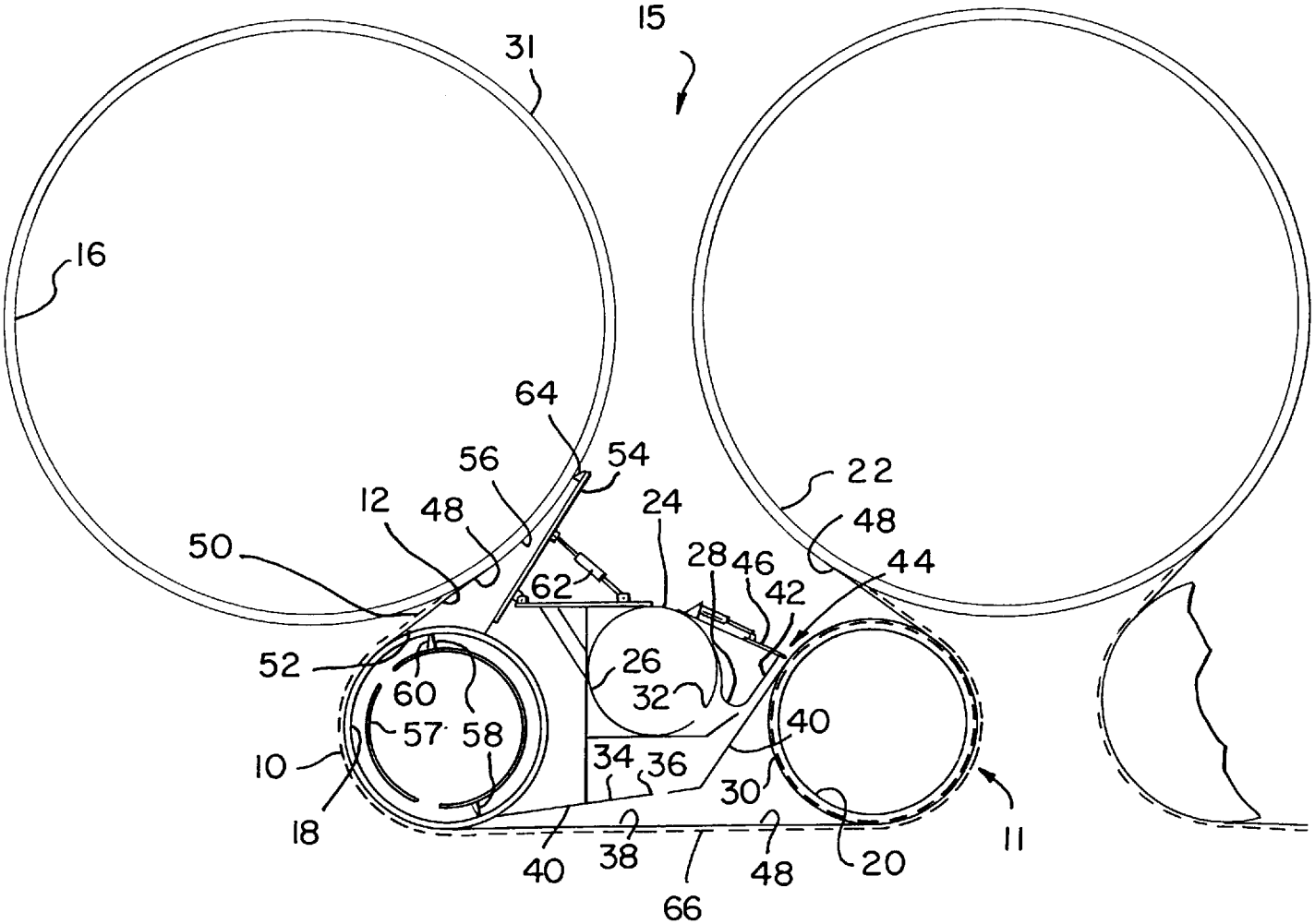
FIG. 2 is a cross-sectional view of a portion of the dryer section of FIG. 1 taken along section line 2—2.
Figure 3:
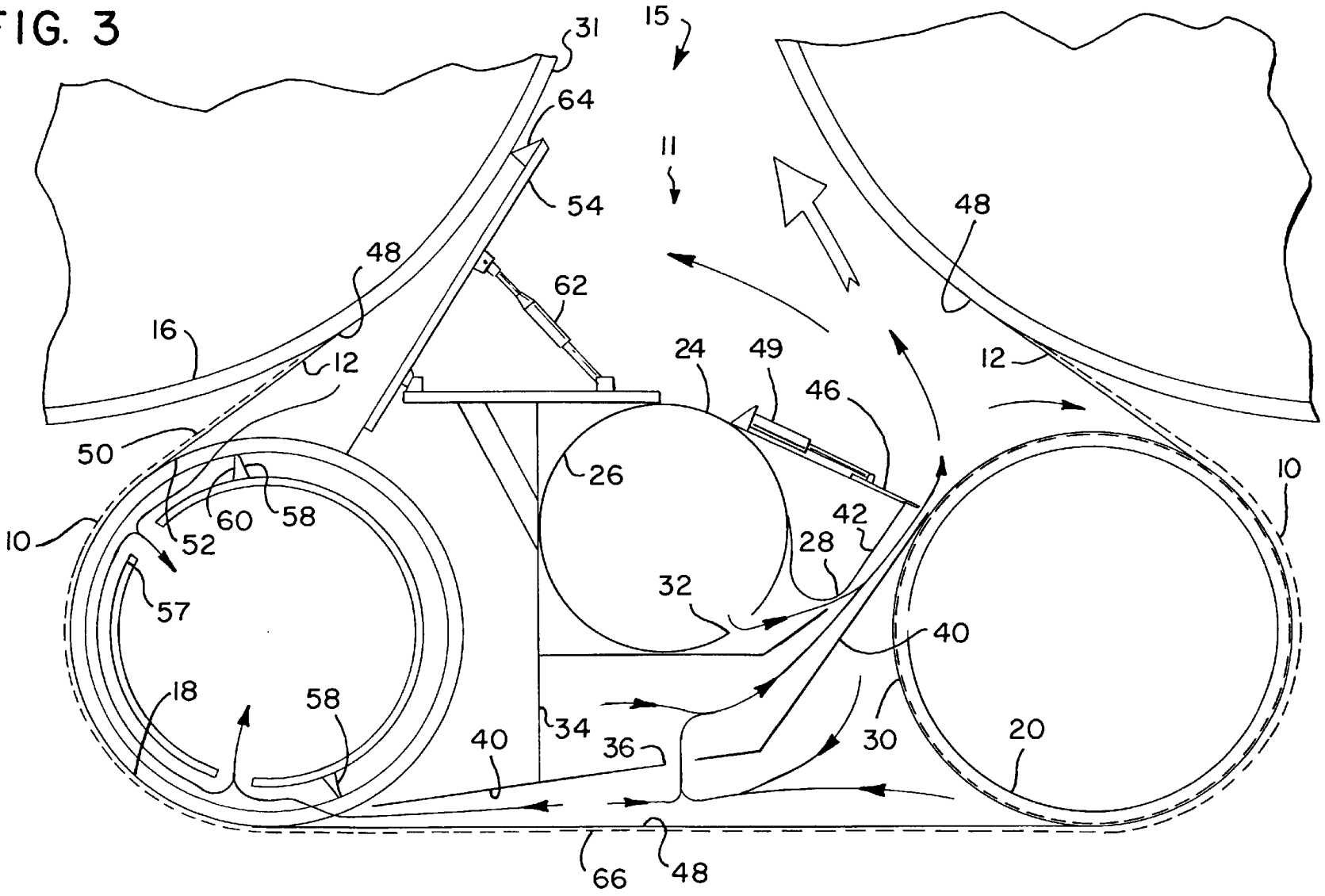
FIG. 3 is a schematic view showing the generated air paths of the apparatus of FIG. 2.

Referring more particularly to FIGS. 1–3, wherein like numbers refer to similar parts, the pocket ventilation and sheet support system 11 of the present invention is shown in FIGS. 1–3. When drying a paper web 10 in a papermaking machine, the paper web 10 is supported on a permeable support felt or dryer fabric 12 that travels along a series of dryer rolls 16, 22 in a dryer section 15.

In a modern highspeed papermaking machine it is desirable that the paper web be constrained at all times as it traverses the dryer section. Web constraint prevents wrinkling of the web and breakage of the web due to sheet flutter. Constraining the web also reduces paper shrinkage which improves paper quality by reducing the tendency of the formed paper to curl. Because of the high speed of a modern papermaking machine, up to 6,000 feet per minute or more, low drying rates can require undesirably long dryer sections. To keep the dryer section of manageable length at high papermaking speeds, it is desirable to increase the amount of drying per unit length of the dryer section. This can be accomplished by increasing the proportion of each dryer roll's surface which is wrapped by the web. Increased drying can also be effected by ventilating the web as it passes between dryers, and by adding supplemental heat to the web with by the use of high velocity, high temperature air impingement hoods such as those manufactured by Beloit Corporation of Beloit, Wis., under the name Air Cap™ dryers, or with infrared heaters.

The web 10 is constrained while passing over the dryer rolls 16, 22 by a dryer fabric 12. The dryer fabric is permeable so water vapor can pass through the fabric 12 as the web is dried on the dryer roll surfaces. Between the dryer rolls 16, 22 the web is constrained by applying a vacuum to the side 31 of the dryer fabric 12 which faces away from the web 10. Typically this is accomplished with a single vacuum roll positioned between adjacent dryer rolls.

A vacuum roll is a cylindrical roll the surface of which is punctured by an array of holes. A nonrotating gland within the vacuum roll draws air through the holes over that portion of the roll on which the dryer fabric is wrapped. The dryer section 15 increases the portion of the circumference of the dryer rolls which is wrapped by the web and the dryer fabric 12 by using two reversing rolls 18, 20. Vacuum rolls, however, are expensive because of the cost of drilling the multitude of holes necessary for their function. Grooved rolls are less expensive to purchase and operate but require a source of vacuum which draws air through the grooves and thus through the dryer fabric as it passes over the grooved roll. Typically a vacuum box is employed with a grooved roll.

The dryer section 15 employs a blow box 24 which is positioned between the vacuum roll 18 and the grooved roll 20. The blow box 24 utilizes pressurized air supplied from a cylindrical duct 26 which utilizes an aerodynamic effect produced by a venturi type nozzle 28 to draw air from the back side 30 of the grooved roll 20. The cylindrical duct 26 has a machine direction slot 32 which supplies air to a nozzle 28 which aspirates air from a baffle chamber 34. The baffle chamber 34 in turn has a cross machine direction distribution slot 36 which draws air from a chamber 38 formed by a baffle plate 40 the dryer fabric (which passes between the vacuum roll 18 and the grooved roll 20) and the back of the grooved roll 30.

The blow box nozzle 28 blows up through a nozzle extension 42 formed between the baffle plate 40 and an upper nozzle plate 42. The air from the cylindrical duct 26 exits through a plurality of holes 44 which extend in the cross machine direction. The width of the holes is controlled by an adjustable baffle 46 which is composed of individual segments 47. The segments 47 are positioned by pneumatic or screw actuators 49 which control the cross machine direction distribution of make-up air. The baffle segments 47 may be adjustable either manually or automatically so that the amount of air passing through the distribution holes 44 is varied in the cross machine direction.

Use of a blow box instead a vacuum box provides several distinct advantages. First, wherever a vacuum roll is used in a pocket, air is removed from the immediate vicinity of the roll. Thus when a vacuum roll is used in a pocket 48 formed by reversing rolls between dryers, air must be supplied to make up for the air removed by the vacuum roll 18. The blow box can supply the make-up air uniformly along the pocket 48 in the cross machine direction. The adjustable baffle 46 allows the amount of make-up air to be matched to the local vacuum.

Blow boxes are also cheaper to operate then vacuum boxes. The blowers for the vacuum boxes must be larger then the blowers for a blow box because the air in a vacuum blower is handled at a lower pressure.

One area of concern which often produces destructive flutter in a paper web being dried is the region 50 between where the web 10 leaves the dryer roll 16 and the line 52 where the web wraps onto the vacuum roll 18. The back 31 of the dryer fabric 12 entrains a boundary layer of air which can become trapped between the vacuum roll 18 and the fabric 12 causing air to pass through the fabric and blow the web off the fabric. This is prevented by a hinged foil or baffle 54 which strips the boundary layer from the back 31 of the dryer fabric 12. The hinged baffle 54 forms a region 56 from which air may be drawn by the vacuum roll 18. The vacuum roll contains a gland 57 within the roll 18 which employs wipers 58 which control that portion of the vacuum roll 18 from which air is drawn. The upper wiper 60 is positioned so that air is drawn from the region 56. The low pressure in the region 56 prevents air from being blown through the fabric 12, and instead causes air to be drawn through the web 10 and the dryer fabric 12 thus restraining the web on the fabric.

The hinged baffle 54 is supported by a pneumatic strut 62 which allows the baffle 54 to pivot away from the dryer roll 16 should a wad of paper travel around the dryer roll 16. The baffle 54 is also responsive to the paper web becoming wrapped around the dryer roll 16. Often when a paper break occurs the broken web winds around a dryer until the papermaking machine can be stopped in response to the detected web break. A small felt wedge 64 is positioned on the end of the baffle 54 closely engaging the dryer roll 16. The felt 64 facilitates the baffle 54 sealing against the dryer fabric 12.

It should be understood that the individual segments 47 of the baffle plate 46 function as guillotine valves and that the holes 44 may be circular or may be oblong with their long axis extending in the cross machine direction.

It should be understood that the portion 66 of the web 10 which travels between the vacuum roll 18 and the grooved roll 20 may be dried with external drying equipment such as an air cap, steam box or infrared heating unit.

It is understood that the invention is not limited to the particular construction and arrangement of parts herein illustrated and described, but embraces such modified forms thereof as come within the scope of the following claims.

We claim:

1. An apparatus for ventilating a vacuum pocket formed between two dryer rolls in a papermaking machine dryer section, the apparatus comprising:

a first heated dryer roll;

a second heated dryer roll spaced downstream from the first dryer roll;

a vacuum roll positioned between the first dryer roll and the second dryer roll;

a circumferentially grooved roll positioned between the vacuum roll and the second dryer roll;

a dryer fabric for transferring and supporting a paper web, the dryer fabric extending over the first dryer roll to the vacuum roll, and from the vacuum roll to the grooved roll, and from the grooved roll to the second dryer roll, wherein the vacuum roll and grooved roll are positioned within the vacuum pocket, the grooved roll spaced from the vacuum roll to define an extended draw of paper web and dryer fabric therebetween;

a region of contact extending from a position along the vacuum roll where the paper web and dryer fabric contact the vacuum roll, to a second position where the paper web and dryer fabric leave the vacuum roll, the vacuum roll generating a partial vacuum in a vacuum zone extending beyond the first and second positions, and including the region of contact between the dryer fabric and the vacuum roll;

a pivoting foil positioned against the first dryer roll, wherein the paper web and dryer fabric together move from the first dryer roll towards the vacuum roll, the pivoting foil extending between the dryer roll and the vacuum roll, thereby defining a region of reduced air pressure between the pivoting foil and the support fabric; and a make-up air generating means for generating a continuous crossmachine distribution of make-up air into the vacuum pocket.

2. The apparatus of claim 1 wherein the make-up air generating means comprises a blow box connected to a source of pressurized air, the blow box extending in the cross-machine direction and positioned between the vacuum roll and the grooved roll within the vacuum pocket, wherein the blow box comprises:

a baffle plate foil extending from the vacuum roll to the grooved roll and diverging from the supporting dryer fabric at an extended draw between the vacuum roll and the grooved roll, and defining a first region between the baffle plate and the dryer fabric;

a duct having a machine direction slot through which air is discharged into a blow box upper chamber;

a nozzle plate defining portions of the blow box upper chamber and having portions defining a nozzle through which air is discharged from the duct;

a blow box lower chamber, positioned beneath the blow box upper chamber, wherein air escaping from the duct through the nozzle plate draws air from the blow box lower chamber;

portions of the baffle plate which define a slot through which air is drawn from the first region into the blow box lower chamber, to create a local zone of lower pressure in the first region;

structure positioned adjacent the grooved roll to define an air outlet for directing pressurized air out of an upper portion of the blow box lower chamber; and a damper positioned adjacent the air outlet for controlling and facilitating the channeling of make-up air in the cross-machine direction.

3. The apparatus of claim 2 wherein the blow box damper is manually adjustable.

4. The apparatus of claim 3 wherein adjustment of the blow box damper is remotely controlled.

5. A dryer section in a papermaking machine comprising:

a first dryer roll;

a second dryer roll spaced from the first dryer roll in a machine direction;

a paper web which traverses the first and second dryer rolls;

a dryer fabric overlying the paper web as it traverses the first and second dryer rolls;

a vacuum roll positioned between the first dryer roll and the second dryer roll;

a grooved roll positioned between the vacuum roll and the second dryer roll;

a pocket between the first and second dryer rolls, the pocket defined between the vacuum roll, the grooved roll and a portion of the web and the dryer fabric which extends from the first dryer roll to the vacuum roll to the grooved roll to the second dryer roll; and a blow box positioned between the vacuum roll and the grooved roll, the blow box supplying vacuum to at least a portion of the dryer fabric which forms the pocket, and supplying vacuum to the grooved roll, the blow box further supplying make-up air to the pocket, to limit the cross machine direction air flows.

6. The apparatus of claim 5 further comprising a baffle mounted on the blow box which extends from the vacuum roll to the dryer fabric positioned on the first dryer roll.

7. The apparatus of claim 5 further comprising a plurality of adjustable baffle segments arrayed in a cross machine direction along the blow box and being selectively actuated to control the amount of make-up air supplied to the pocket from the blow box.

8. The apparatus of claim 5 wherein the vacuum roll has a gland which controls that portion of the vacuum roll surface through which air is drawn, and wherein the gland draws air from that portion of the vacuum roll wrapped by the web and dryer fabric and in addition draws air from a portion of the vacuum roll preceding and following the wrapped portion of the vacuum roll.

9. The apparatus of claim 6 further comprising a felt seal mounted to the baffle and positioned between the baffle and the dryer roll to engage the dryer roll.

10. A dryer section in a papermaking machine comprising:

a first dryer roll;

a second dryer roll positioned downstream of the first dryer roll;

a vacuum roll positioned between the first dryer roll and the second dryer roll;

a grooved roll positioned between the vacuum roll and the second dryer roll;

a paper web extending from the first dryer roll to the second dryer roll;

a dryer fabric engaged with the paper web, and supporting the paper web as it travels from the first dryer roll to the vacuum roll, from the vacuum roll to the grooved roll, and from the grooved roll to the second dryer roll;

a pocket defined between the vacuum roll, the grooved roll and a portion of the web and the dryer fabric which extends from the first dryer roll to the vacuum roll to the grooved roll to the second dryer roll; and a duct extending in a cross machine direction and communicating with the pocket, such that air is discharged from the duct into the pocket;

structure positioned within the pocket which defines a nozzle communicating with the duct and discharging to the grooved roll to supply make-up air where the dryer fabric and the web separate from the grooved roll and travel onto the second dryer roll;

a baffle plate positioned beneath the duct and extending from the vacuum roll to the grooved roll, and having portions defining an opening therein, the opening communicating with a lower region adjacent the dryer fabric as it extends between the vacuum roll and the grooved roll, wherein the discharge of air through the nozzle draws air through the opening, wherein the discharged air is thus made available as make-up air to the pocket.

11. The apparatus of claim 10 further comprising a baffle positioned to extend between a position engaging the dryer fabric on the first dryer roll, and a position engaging the vacuum roll, the baffle thereby defining a region between the baffle, the dryer fabric, and the vacuum roll, said region being subjected to reduced air pressures as air is drawn from said region by the vacuum roll.

12. The apparatus of claim 11 wherein the baffle is pivotably mounted to permit the passage of wads between the dryer fabric and the baffle.

13. The apparatus of claim 10 further comprising at least one baffle positioned with respect to the baffle plate to define a slot discharge air to the grooved roll, the baffle being positionable to control the quantity of air discharged through said slot.

14. The apparatus of claim 13 further comprising a plurality of adjustable baffle segments which are independently adjustable to control make-up air discharged in the cross machine direction.

* * * * *